US007791600B2

(12) United States Patent
Shirasaki

(10) Patent No.: US 7,791,600 B2
(45) Date of Patent: Sep. 7, 2010

(54) DRIVING POWER-SUPPLY CIRCUIT

(75) Inventor: Hijiri Shirasaki, Miyazaki (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 880 days.

(21) Appl. No.: 11/494,765

(22) Filed: Jul. 28, 2006

(65) Prior Publication Data

US 2007/0035537 A1 Feb. 15, 2007

(30) Foreign Application Priority Data

Jul. 29, 2005 (JP) ..... 2005-219770

(51) Int. Cl.
*G09G 5/00* (2006.01)

(52) U.S. Cl. ..... 345/211; 345/87; 345/88; 345/89; 345/204

(58) Field of Classification Search ..... 345/211, 345/204, 87–89
See application file for complete search history.

(56) References Cited

FOREIGN PATENT DOCUMENTS

JP 07-113862 5/1995

*Primary Examiner*—Richard Hjerpe
*Assistant Examiner*—Leonid Shapiro
(74) *Attorney, Agent, or Firm*—Rabin & Berdo, P.C.

(57) ABSTRACT

The object of the present invention is reducing power consumption of a driving power supply circuit.

In the case where the driving voltage Vi is higher than the reference voltage ViH, The signal S3P, S3N of the differential amplifier 30P, 30N become level "L" concurrently, and the signal S4P, S4N of the output circuit 40P, 40N become level "H". Subsequently, the NMOS 62 becomes on-state and decreases the driving voltage Vi of the node N6. At the above stage, the control signal CP becomes level "L", then the operation of the constant current circuit 20P is halted.

In the case where the driving voltage Vi is lower than the reference voltage ViL, the PMOS 61 becomes on-state and increases the driving voltage Vi, and concurrently the operation of the constant current circuit 20P halts. At the same time, in the case where the reference voltage ViL is lower than the driving voltage Vi and the driving voltage Vi is lower than the reference voltage ViH, the signal S4P, S4N become level "H", respectively, the PMOS 61 and the NMOS 62 become off-state, however, the control signal CP, CH become level "H", then monitoring the driving voltage Vi is conducted by the comparing circuits thereof.

7 Claims, 4 Drawing Sheets

CONVENTINAL REFERENCE VOLTAGE GENERATING CIRCUIT

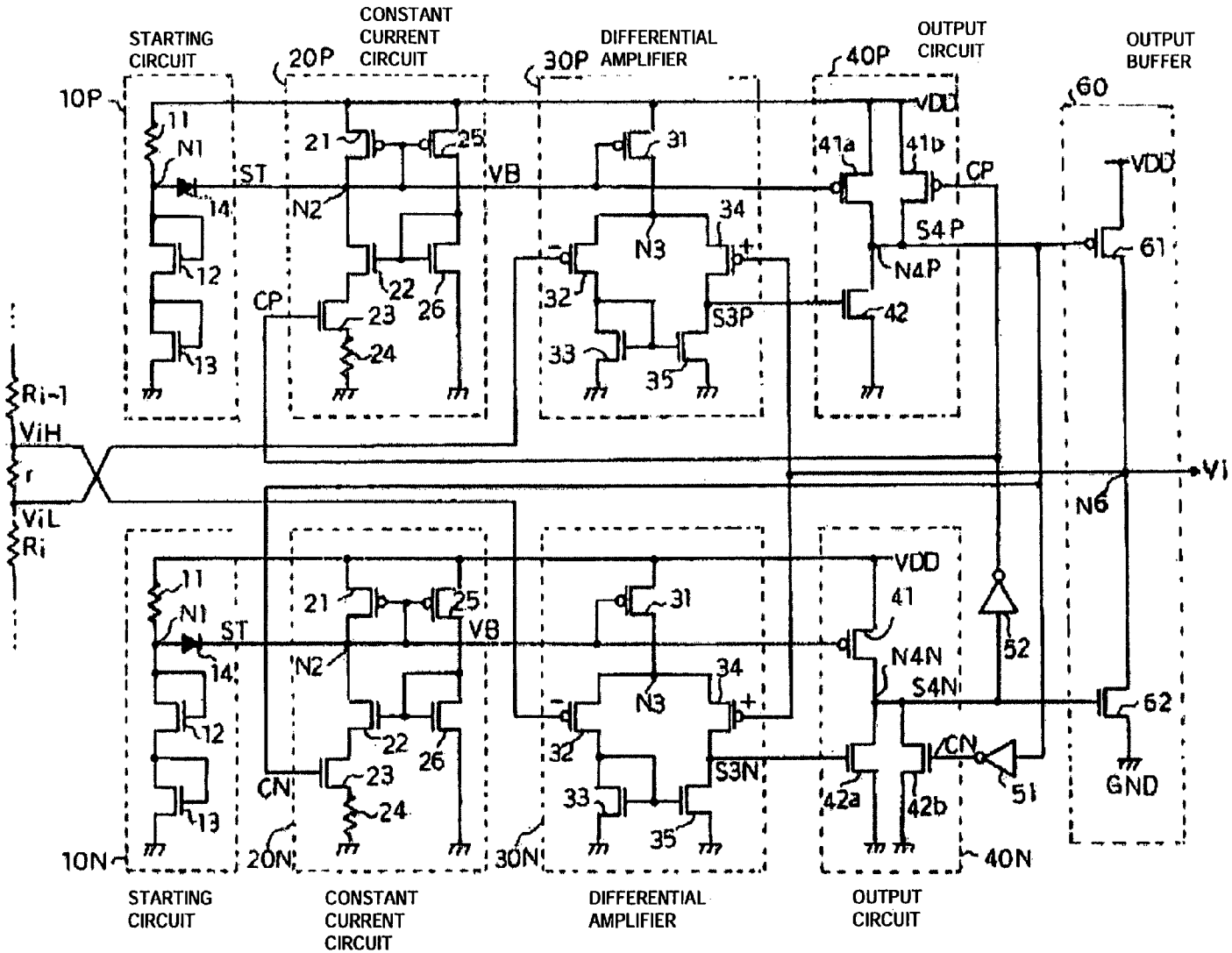
Fig.1 DRIVER POWER SUPPLY CIRCUIT ACCORDING TO FIRST EMBODIMENT

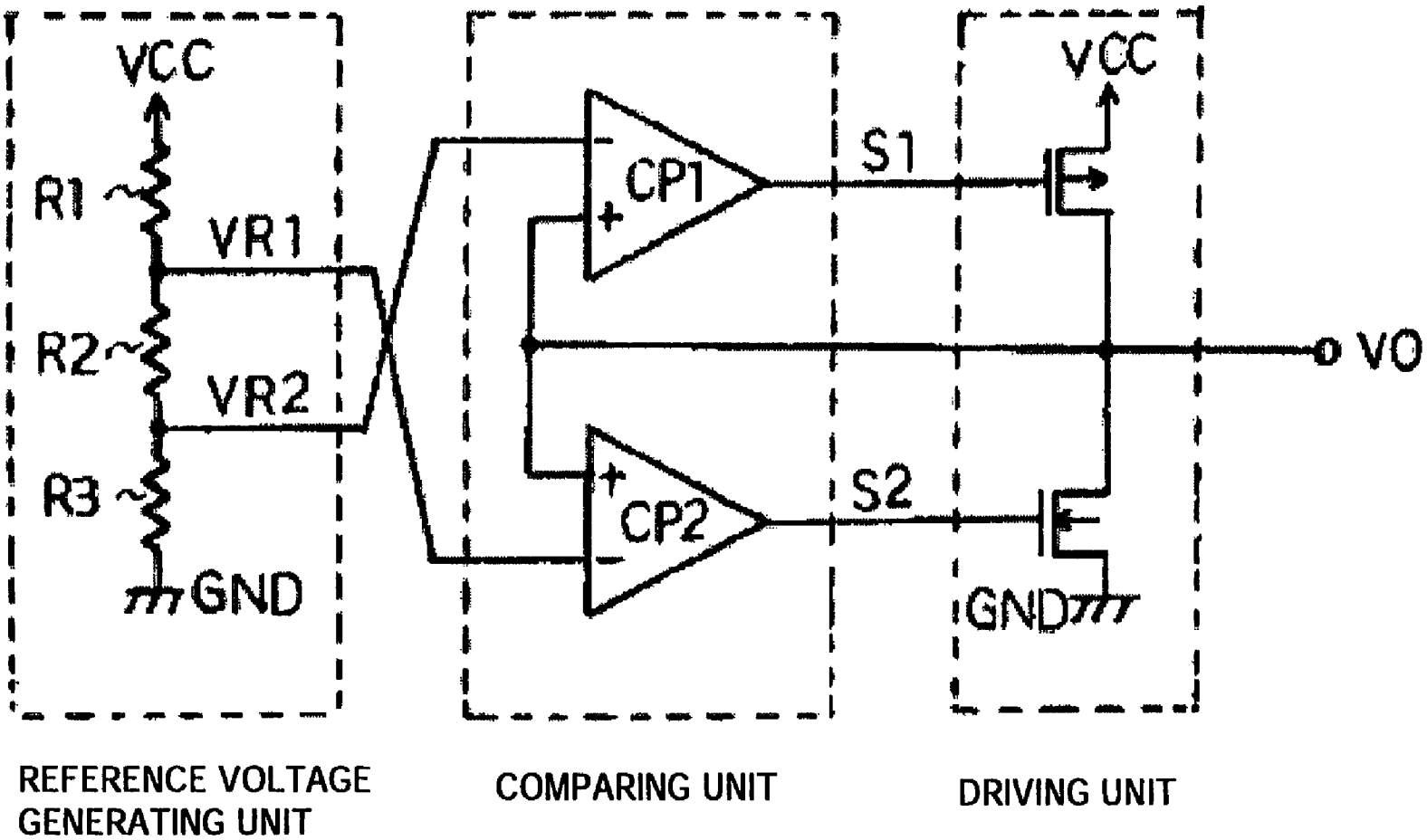
Fig.2 CONVENTINAL REFERENCE VOLTAGE GENERATING CIRCUIT

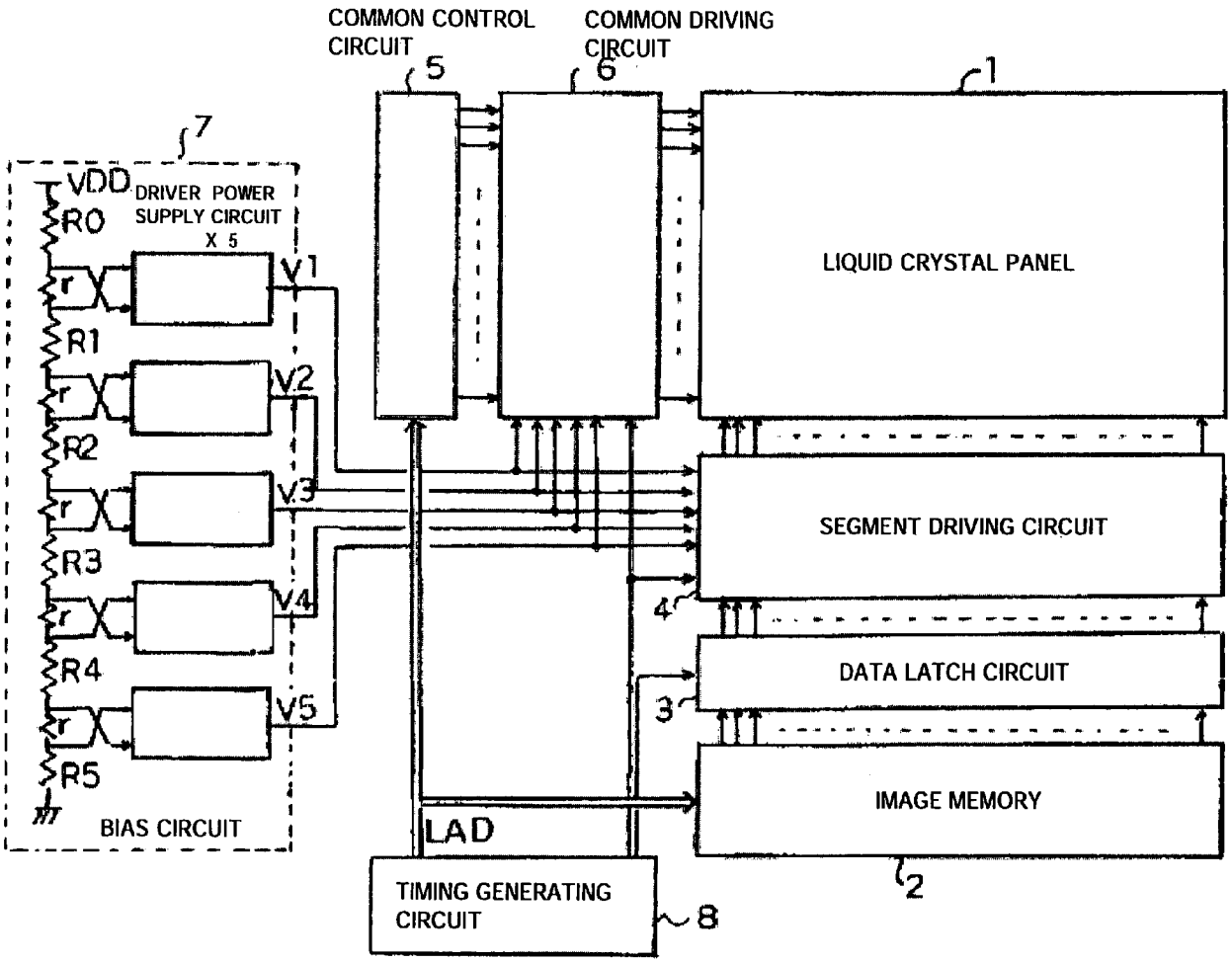
Fig..3 LOIQUID CRYSTAL DISPLAY EQIPMENT USING DRIVER POWER SUPPLY CIRCUIT OF FIG.1

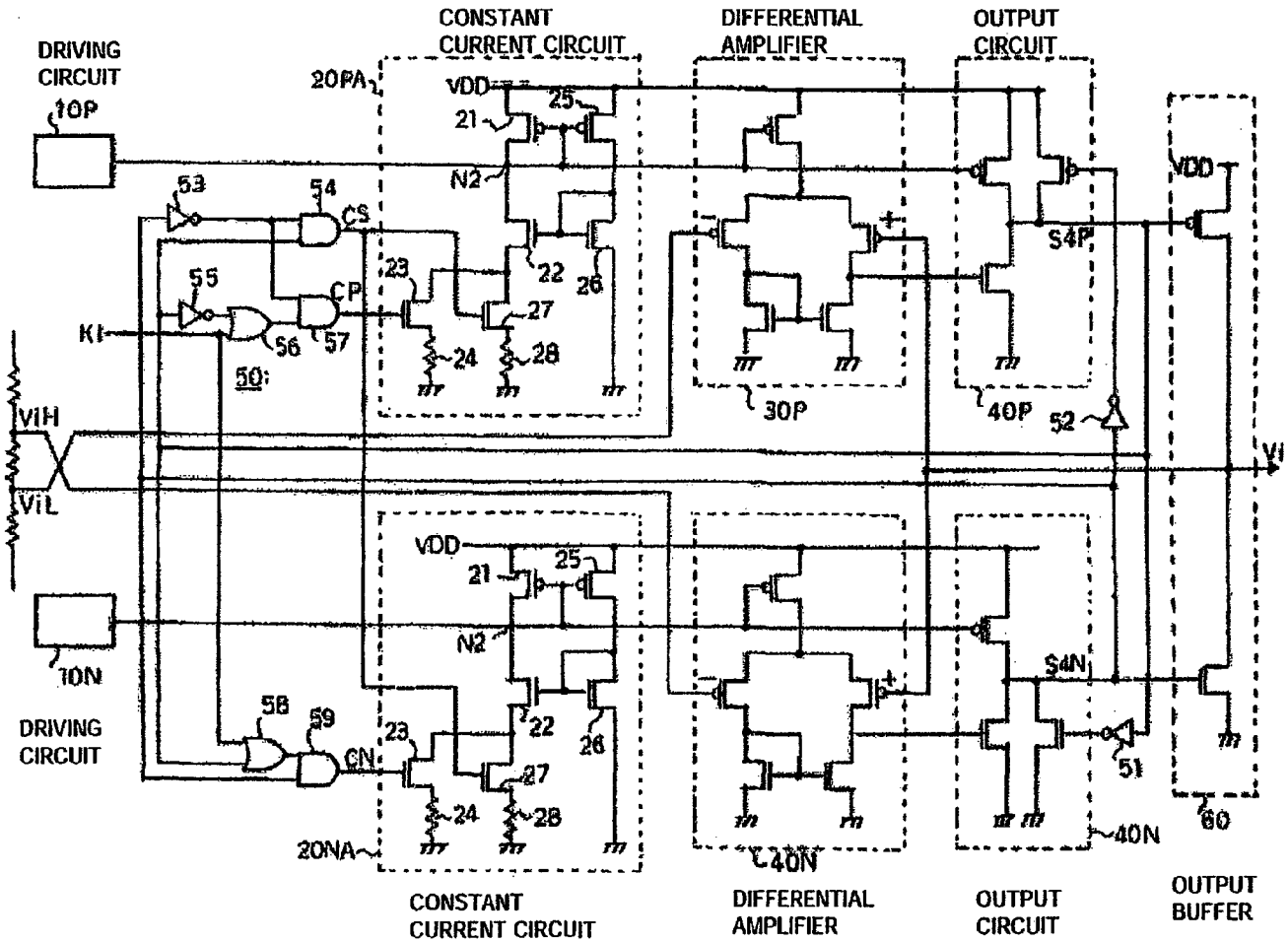
Fig.4 DRIVER POWER SUPPLY CIRCUIT ACCORDING TO SECOND EMBODIMENT

DRIVING POWER-SUPPLY CIRCUIT

BACKGROUND OF THE INVENTION

The present invention relates to a driving power-supply circuit generating driving voltage for a liquid-crystal display equipment, etc.

Patent document 1: Japanese Patent Publishing No. H7-113862.

FIG. 2 is a configuration diagram of a conventional reference voltage generation circuit described in the above patent document 1.

The reference voltage generation circuit thereof consists of a reference voltage generating unit, comparing unit, and a driver unit. The reference unit generates a reference voltage VR1, VR2 (wherein VR1>VR2) by a voltage dividing resistor R1, R2, and R3 being connected in serial between the supply voltage VCC and the ground voltage GND. The comparing unit includes a comparator CP1, CP2 comparing the reference voltage VR1, VR2 to an output voltage VO respectively, and a control signal S1, S2 outputs from the CP1, CP2 respectively. The driver unit consists of a P-channel MOS transistor (hereinafter refer to as "PMOS") and a N-channel MOS transistor (hereinafter refer to as "NMOS"). The PMOS thereof is connected between the supply voltage VCC and an output terminal outputting the output voltage VO and is controlled to on-state or off-state by the control signal S1. The NMOS thereof is connected between the above output terminal and the ground voltage GND and is controlled to on-state or off-state by the control signal S2.

In the above reference voltage generation circuit, both of the control signal S1, S2 become high logic level (hereinafter refer to as level "H") in the case where VO is higher than VR1. Subsequently, the PMOS become off-sate and the NMOS becomes on-state, then the output terminal is connected to the ground GND through NMOS and the output voltage VO falls.

In the case where VO is lower than VR2, both of the control signal S1, S2 become low logic level (hereinafter refer to as level "L"). Subsequently, the PMOS become on-state and the NMOS becomes off-state, then the output terminal is connected to the supply voltage VCC through PMOS and the output voltage VO rises.

Further, in the case where VR2 is lower than VO and VO is lower than VR1, the control signal S1, S2 become level "H", level "L" respectively. Subsequently, both of PMOS and NMOS become off-state, and the output voltage VO is held at a level of between the reference voltage V2 and the reference voltage VR1.

In the above patent document 1, there is no description of the specific circuit configuration regarding the comparator CP1, CP2 of the reference voltage generation circuit, however, it can be assumed that a common operational amplifier is applied thereto. The operational amplifier consists of a differential amplifier and a constant-current circuit for providing a constant current to the amplifier thereof. For the above reason, a constant current always flows into the comparator CP1, CP2. Since the constant current thereof needs to be increased in proportion to the response speed of the comparator CP1, CP2, there is a problem that the faster the response speed of the reference voltage generation circuit becomes, the more the consumption current of the reference voltage generation circuit becomes, as well as the load current being provided an actual load. The object of the present invention is to decrease the power consumption of the driving power-supply circuit.

SUMMARY OF THE INVENTION

The present invention has a configuration consisting of a driving power-supply circuit, PMOS, NMOS, a first comparing circuit, and a second comparing circuit. The driving power-supply circuit outputs the driving voltage from an output node, controlling the voltage thereof to stay at between the lower reference voltage and the upper reference voltage.

The POMS being connected to between the supply voltage and the above output node becomes off-state when a first signal is level "H", and becomes on-state when the first signal is level "L".

The NOMS being connected to between the above output node and the ground voltage, becomes off-state when a second signal is level "L", and becomes on-state when the second signal is level "H".

The first comparing circuit compares the above lower reference voltage to the above driving voltage when the above second signal is level "L", and the first comparing circuits operates as below. In the case where the above driving voltage is higher than the above lower reference voltage, the first comparing circuit outputs the first signal by setting the level thereof to level "H". In the case where the above driving voltage is lower than the above lower reference voltage, the first comparing circuit outputs the first signal by setting the level thereof to level "L". In the case where the above second signal is level "H", the first comparing circuit halts the comparing operation thereof and outputs the first signal by setting the level thereof to level "H".

The second comparing circuit compares the above upper reference voltage to the above driving voltage when the above first signal is level "H", and the second comparing circuit operates as below. In the case where the above driving voltage is higher than the above upper reference voltage, the second comparing circuit outputs the second signal by setting the level thereof to level "H". In the case where the above driving voltage is lower than the above upper reference voltage, the second comparing circuit outputs the second signal to level "L". In the where the above first signal is level "L", the second comparing circuit halts the comparing operation thereof and sets outputs the second signal by setting the level thereof to level "L".

In the present invention, the second circuit operation is halted when the first signal from the first comparing circuit is level "L", that is, when the driving voltage is lower than the lower reference voltage, so that the driving voltage can be controlled only by the first comparing circuit. At the same time, the first circuit operation is halted when the second signal from the second comparing circuit is level "H", that is, when the driving voltage is higher than the upper reference voltage, so that the driving voltage can be controlled only by the second comparing circuit. Subsequently, when the driving voltage becomes out of the reference voltage range, only the comparing circuit conducting the driving voltage adjustment is activated, other comparing circuits not conducting driving voltage adjustment are halted, then there is an effect that the power consumption cab be decreased.

The configuration of the present invention consists of a logic circuit, a first comparing circuit, and a second comparing circuit.

The logic circuit outputs a first control signal when the first signal and the second signal are level "L", outputs a second signal when the first signal and the second signal are level "H", and outputs a third signal when the first signal is level "H" and the second signal is level "L".

The first comparing circuit compares the lower reference voltage to the driving voltage in fast-operation mode thereof when the first control signal is inputted thereto, and in low power consumption mode thereof when the third control signal is inputted thereto, then the first comparing circuit outputs the first signal by setting the level thereof to level "H" when the driving voltage is higher than the lower reference voltage, and the first comparing circuit outputs the first signal by setting the level thereof to level "L" when the driving voltage is lower than the lower reference voltage.

The second comparing circuit compares the upper reference voltage to the driving voltage in fast-operation mode thereof when the second control signal is inputted thereto, and in low-power-consumption mode thereof when the third control signal is inputted thereto, then the second comparing circuit outputs the second signal setting the level thereof to level "H" when the driving voltage is higher than the upper reference voltage, and the second comparing circuit outputs the second signal by setting the level thereof to level "H" when the driving voltage is lower than the upper reference voltage.

Furthermore, the logic circuit thereof can be configured to output the first, the second, and the third control signal in the case where a changing signal indicating that a circuit of the load side providing the driving voltage is changed when the first signal is level "H" and the second signal is level "L".

BRIEF DESCRIPTION OF THE DRAWINGS

FIG. 1: A circuit diagram of the driving power supply circuit according to a first embodiment of the present invention.

FIG. 2: A configuration diagram of a conventional reference voltage generating circuit.

FIG. 3: A configuration diagram of a liquid-crystal display equipment using a driving power supply circuit of FIG. 1.

FIG. 4: A circuit diagram of the driving power supply circuit according to a second embodiment of the present invention.

DETAILED DESCRIPTION OF THE PREFERRED EMBODIMENTS

First Embodiment

As shown in FIG. 3, a liquid-crystal equipment includes a liquid-crystal panel 1 having a 33 column by 102 pixel display screen and a image memory 2 storing the 33 column by 102 pixel display information. The image memory is configured to output the 33 column by 102 pixel display data in parallel one by one line, corresponding to a line address LAD, and the data latch circuit 3 holding the display data is connected to the output side of the image memory thereof. Furthermore, the display data held by the data latch circuit 3 is provided the segment driving circuit 4.

The segment driving circuit 4 is configured to drive 102 of segment electrodes of the liquid-crystal equipment 1 at the same time, is configured to select the driving voltage selecting out of the driving voltage V1-V5 for each segment electrode, based on the displaying data corresponding to each segment electrode and the frame-select signal being changed by every displaying frame, and is configured to output the selected deriving voltage thereof.

Furthermore, the above liquid-crystal display equipment includes a common control circuit 5 selecting the common electrode for displaying by the line address LAD, and a common driving circuit 6. The common driving circuit 6 drives the corresponding common electrode of the liquid-crystal panel 1 being selected the common control circuit 5, and selects the corresponding driving voltage out of the driving voltage V1-V5 by the frame control signal and outputs the selected voltage thereof. The driving voltage V1-V5 provided the segment driving circuit 4 and the common driving circuit 6; is generated by the bias circuit 7.

A bias circuit 7 consists of a resistor voltage divider and five driving power supply circuits. The voltage-divider generates the reference voltage corresponding to the driving V1-V5 by dividing voltage between power supply voltage VDD and the ground voltage VDD. The driving power supply circuit generates the above driving voltage V1-V5 from the reference voltage.

The resistor voltage-divider consists of six of the high resistors R0-R5 and resistors r having very low resistance. The high resistors R0-R5 dividing the voltage between the supply power voltage VDD and the ground voltage GND into the voltages corresponding to the driving voltage V1-V5. A couple of reference voltages ViH, ViL (wherein i=1-5) are outputted from each both ends of the resistors r being connected the high resistors R0-R5. The driving power supply circuit outputs the driving voltage Vi having acceptable variation of ViH-ViL with low impedance, based on the upper reference voltage ViH and the lower reference voltage ViL.

Additionally, in the above liquid crystal equipment, a timing generating circuit 8 is configured to generate the line address LAD given to the image memory 2 and the common control circuit 5, the frame control signal given to the segment driving circuit 4 and the common driving circuit 6, and the timing signals such as the latch signal, etc. given to the data latch circuit 3.

As shown in FIG. 1, the driving power supply circuit includes the first comparing circuit, the second comparing circuit, and an output buffer 60. The first comparing circuit consists of a starting circuit 10P, a constant current circuit 20P, a differential amplifier 30P, and output circuit 40P. The second comparing circuit consists of a starting circuit 10N, a constant current circuit 20N, a differential amplifier 30N, and output circuit 40N. The output buffer 60 outputs the driving voltage Vi, being controlled by the output signals from the above first and second comparing circuit.

The starting circuit 10P, 10N have the same circuit configuration including a resistor 11 connected between the supply voltage VDD and the node N1, the NMOS 12, 13 connected serially in the forward direction by diode-connection between the above node N1 and the ground voltage GND, and a diode 14 having the plus electrode thereof connected to the node N1 and the minus electrode thereof outputting a starting signal ST. The starting circuit 10P, 10N are circuits to apply the predetermined constant currents to the constant current circuit 20P, 20N, providing the starting signal ST to the above constant current circuit 20P, 20N by the diode 14 becoming forward-direction while the supply power voltage VDD is rising. When the supply voltage VDD reaches to the specific value, the diode becomes reverse-direction, then the starting circuit 10P, 10N are configured to be separated from the constant circuit 20P, 20N.

The constant current 20P, 20N have the same circuit configurations, and includes a PMOS 21 connected between the power supply voltage VDD and the node N2, NMOS 22, 23 connected serially between the above mode N2 and the ground voltage GND, and the resistor 24. The gate of the PMOS 21 is connected to the node N2 and to the gate of the PMOS 25. The source of the PMOS 25 is connected to the power-supply voltage VDD and the drain thereof is connected to the ground through the NOMS 26. At the same time, the gates of NMOS 22, 26 are connected to the drain of the NMOS 26.

The node N2 of the constant current circuit 20P is given the starting signal ST of the starting circuit 20P, and the gate of the NMOS 23 is given a control signal CP from the second comparing circuit. Subsequently, a bias voltage VB can be outputted from the node N2 to apply the constant current when the control signal CP is level "H".

The node N2 of the constant current circuit 20N is given the starting signal ST of the starting circuit 20N, and the gate of the NMOS 23 is given a control signal CN from the first comparing circuit. Subsequently, the bias voltage VB can be outputted from the node N2 to flow the constant current when the control signal CN is level "H".

The differential amplifiers 30P, 30N have the same circuit configurations consisting of the PMOS 31 connected between the power supply voltage VDD and the node N3, the PMOS 32 and the NMOS 33 connected serially between the above node N3 and the ground voltage GND, and the PMOS 34 and the NMOS 35 connected serially between the node N3 and the ground voltage GND. The gate of the NMOS 33, 35 are connected the drain of the NMOS 32. The gate of the PMOS 31 is given the bias voltage VB to the gate of the PMOS 31.

The gates of the PMOS 32, 34 of differential amplifier 30P are given the reference voltage ViL and the ViH, respectively. In the case of Vi>ViL, a signal S3P of level "L" is outputted from the drain of the NMOS 35. In the case of Vi<ViL, the signal of level "H" is outputted.

At the same time, the gates of the PMOS 32, 34 of the differential amplifier 30N are given the reference voltage ViH and the driving voltage Vi respectively. In the case of Vi>ViH, a signal S3N of level "L" is outputted from the drain of the NMOS 35. In the case of Vi<ViH, the signal SN3 of level "H" is outputted.

The output circuit 40P consists of the PMOS 41*a*, 41*b* connected in parallel between the power supply voltage VDD and the node N4P, NMOS 42 connected between the above N4P and the ground voltage GND. The gate of the PMOS 41*a* is given the bias voltage VB from the constant current circuit 20P, and the gate of the NMOS 42 is given the control signal CP. At the same time, the gate of the PMOS 41*b* is given the control signal CP and the signal S4P is outputted from the node N4P thereof. The signal S4P is given to the constant current circuit 20N as the control signal CN, and at the same time the signal S4P is inverted by an inverter 51 and is given to the output circuit 40N as the control signal /CN.

At the same time, the output circuit 40N consists of the PMOS 41 connected between the power supply voltage VDD and the node N4N, the NMOS 42*a*, 42*b* connected in parallel between the above node N4N and the ground voltage GND. The gate of the PMOS 41 is given the bias voltage VB from the constant current circuit 20N, and the signal S3N is given the gate of the NMOS 42*a*. Additionally, the gate of the PMOS 41*b* is given the control signal /CN, and the signal S4N is outputted from the node N4N. The signal S4N is inverted by the inverter 52 and is given the first comparing circuit as the control signal CP.

The output buffer 60 consists of the PMOS 61 being connected between the power supply voltage VDD and the node N6 and being controlled to on-state or off-state by the signal S4P, and the NMOS 62 being connected between the above node N6 and the ground voltage GND and being controlled to on/off state by the signal S4N. The driving voltage Vi is outputted from the above N6.

The operation will be explained as below.

When the power supply voltage is low immediately after the supply voltage is turned on, the voltage provided the NMOS 12,13 of the starting circuit 10P, 10N is less than the threshold, and the NMOS 12,13 thereof become off-state, then the voltage of the node N1 rises with the power supply voltage VDD. The voltage of the node N1 is given to the constant circuit 20P, 20N as the starting ST through the diode 14, and the constant circuit 20P, 20N thereof become on-state. When the power supply voltage VDD rises and surpasses the threshold thereof, the NMOS 12, 13 thereof become on-state, then the voltage rising of the node N1 is halted. When the power supply voltage rises further and reaches to the given value, the diode 14 becomes reverse direction and the starting circuit 10P, 10N is separated, then the operation thereof is shifted to the normal state.

(1) The Operation in the Case where the Driving Voltage is Higher than ViH.

In the differential circuit 30P, the PMOS 32 becomes on-state and the PMOS 34 becomes off-state, then the signal S3P becomes level "L". Subsequently, the NMOS 42 of the output circuit 40P becomes off-state, then the signal S4P becomes level "H". Furthermore, the control signal CN, /CP becomes level "H", level "L", respectively. In similarity, in the differential amplifier 30N, the PMOS 32 becomes on-state and the PMOS 34 becomes off-state, then the signal S3N becomes level "L". Subsequently, the NMOS 42 of the output circuit 40P becomes off-state, then the signal S4N becomes level "H", and the control signal CP becomes level "L".

Since the signal S4P and S4N become level "H" concurrently, the PMOS 61 of the output buffer 60 becomes off-state and the NMOS 62 thereof becomes on-state. Subsequently, the node N6 is connected to the ground voltage GND through the NMOS 62, than the voltage from the node N6 thereof is decreased.

At the same time, as the control signal CN is level "H", the constant current circuit 20N operates in the normal state, and supplies the given bias voltage VB to the differential amplifier 30N and the output circuit 40N. Additionally, since the control signal CP is level "L", the operation of the constant circuit 20P is halted and the operations of the differential amplifier 30P and the output circuit 40P are halted. Furthermore, the PMOS 41*b* of the output circuit 40P becomes on-state, and the signal S4P is fixed to level "H".

(2) The Operation in the Case where the Driving Voltage is Between the Reference Voltage ViH and ViL.

The differential amplifier 30P operates as in the case of the above (1). The PMOS 32 becomes on-state and the PMOS 34 becomes off-state, then the signal S3P becomes level "L". Subsequently, the NMOS 42 of the output circuit 40P becomes off-state, then the signal S4P becomes level "H". Furthermore the control signal CN, /CN becomes level "H", "L", respectively. At the same time, in the differential amplifier 30N, the PMOS 32 becomes off-state, the PMOS 34 becomes on-state, and the signal S3N becomes level "H". Subsequently, the NMOS 42 of the output circuit 40N becomes on-state and the signal S4N becomes level "L", then the control signal CP becomes level "H".

The signal S4P, S4N becomes level "H", level "L", respectively, then the PMOS 61 and the NMOS 62 of the output buffer 60 become off-state concurrently. Consequently, the node N6 is separated from the power supply voltage VDD and the ground voltage GND, then the driving voltage Vi of the node N6 thereof is maintained at the same level.

At the above-mentioned time, the control signal CN is level "H", then the constant current circuit 20N operates in the normal state and supply the predetermined voltage bias voltage VB to the differential amplifier 30N and the output circuit 40N. At the same time, the control signal CP is level "H", too, then the constant current circuit 20P operates in the normal state and supplies the predetermined bias voltage VB to the differential circuit 30P and the output circuit 40P.

(3) The Operation in the Case where the Driving Voltage Vi is Lower than the Reference Voltage ViH.

The differential amplifier 30P, the PMOS 32 becomes off-state, and the PMOS 34 becomes on-state, then the signal S3P becomes level "H". Subsequently, the NMOS 42 of the output circuit 40P becomes on-state, then the signal S4P becomes level "L". Additionally, the control signal CN, /CN becomes level "L", "H", respectively. At the same time, the differential amplifier 30N operates as described in the above (3), then the PMOS 32 thereof becomes of-state and the PMOS 34 becomes on-state, then the signal S3N becomes level "H". Subsequently, the NMOS 42 of the output circuit 40N becomes on-state and the signal S4N becomes level "L", then the control signal CP becomes level "H".

Since the signal S4P, S4N becomes level "L" concurrently, the PMOS 61 of the output buffer 60 becomes on-state and the NMOS 62 thereof becomes off-state. Subsequently, the node N6 is connected to the power supply voltage VDD through PMOS 61, then the driving voltage Vi from the node N6 thereof rises.

The control signal CP is level "H", then the constant current circuit 20P operates in the normal state and provides the predetermined bias voltage VB to the differential amplifier 30P and the output circuit 40P. Additionally, the control signal CN is level "L", then the operation for the constant circuit 20N is halted and the operations of the differential amplifier 30N and the output circuit 40N are halted, too. Furthermore, since the control signal /CN is level "H", the NMOS 42 of the output circuit 40N becomes on-state and the signal S4N is fixed to level "L".

By the above mentioned operations, the driving voltage Vi is controlled to have the value thereof between the lower reference ViL voltage and the upper reference voltage ViH.

As explained before, the driving power supply circuit according to the first embodiment of the present invention is configured to output the driving voltage Vi by the low impedance output buffer 60. Subsequently, since the above driving power supply circuit can respond immediately to the case where the driving voltage is changed in the segment driving circuit 4 and the common driving circuit 6, the above driving power supply circuit can output constantly the reference voltage having the predetermined voltage range.

Furthermore, in the case where the driving voltage Vi becomes higher than the reference voltage range, the driving power supply circuit thereof halts the operation of the first comparing circuit and monitors the driving voltage Vi only by the second comparing circuit, and in the case where the driving voltage Vi becomes lower than the reference voltage range thereof, the driving power supply circuit thereof halts the operation of the second comparing circuit and monitors the driving voltage Vi only by the first comparing circuit. Subsequently, since the redundant operation to activate the two comparing circuits thereof simultaneously can be eliminated in the case where the driving voltage Vi becomes out of the reference range, the driving power supply circuit according to the first embodiment of the present invention has the effect that the power consumption thereof can be decreased.

Additionally, the present invention is not limited to the above first embodiment and can be applicable to various modifications. The above modification examples are as follows.

(a) The configuration of the starting circuit, the constant current circuit, the differential amplifier, and the output circuit is one of examples and is not limited to the circuits shown therein.

(b) The driving power supply circuit according to the second embodiment is explained as a circuit being applied to a liquid crystal display equipment, however, the above driving power supply circuit can be applied to other display equipments other than a liquid crystal display equipment thereof.

Second Embodiment

FIG. 4 is a circuit diagram of the driver according to the second embodiment of the present invention. An element thereof identical to the one in FIG. 1 is given the same numeral as in FIG. 1.

The above driving power supply circuit has a configuration consisting of a constant current circuit 20PA, 20NA having slightly different configuration instead of the constant current circuit 20P, 20N of FIG. 1, and a logic gate 50 having a logic gates 53-59.

The constant current circuit 20PA, 20NA have the same circuit configurations, consisting of a PMOS 21 connected between the power supply voltage VDD and the node N2, a NMOS 22, 23 connected serially between the node N2 thereof and the ground voltage GND, and a resistor 24. The gate of the PMOS 21 is connected to the node N2 and a gate of a PMOS 25. The source of the PMOS 25 is connected to the power supply voltage VDD and the drain thereof is connected to the ground voltage GND through a NMOS 26. The gates of the NMOS 22, 26 are connected to the drain of the NMOS 26.

Furthermore, the NMOS 27 and the resistor 28 are serially connected in parallel with the NMOS 23 and the resistor 24 between the source of the NMOS 22 and the ground voltage GND, wherein the value of the resistor 27 is set to a larger value than the register 24. When the NMOS 23 becomes off-state and the NMOS 27 becomes on-state, the operation thereof is done in a low power consumption mode.

At the same time, the logic circuit 50 compose by the logic gates 53-59 controls the NMOS 23, 27 in the constant current circuit 20PA, 20NA, base on the signal S40P, S40N from the output circuit 40P, 40N and the changing pulse signal KI provided only during a short period when the driving voltage driving the segment electrodes or the common electrodes is changed. Additionally, the changing signal KI is provided from the from the timing generating circuit 8 of FIG. 3, for example. From the driving power supply circuit side, the above changing signal KI is a signal indicating that the circuit on the load side supplying the driving voltage Vi is changed.

The signal S4N is inverted by the inverter 53 and is provided one of the input sides of AND gate 54, and the signal S4P is provided the other input side thereof. Furthermore, the control signal CS from the AND gate 54 is given to the gate of the NMOS 27 of the constant current circuit 20PA, 20NA.

Additionally, the signal S4P is inverted by the inverter 55 and is provided one of input sides of the OR gate 56, and the changing signal KI is given to the other input side of the OR gate 56. The output side of the OR gate 56 is connected to one of the input sides of the AND gate 57, and the output signal from the inverter 53 is given to the other input side. Then, the control signal CP from the AND gate 57 is provided the gate of the NMOS 23 of the constant current circuit 20PA.

Furthermore, OR login operation is conducted between the signal S4P and the changing signal KI by the OR gate 58, then the result thereof is provided one of the input sides of the AND gate 59. The signal S4N is given to the other side of the AND gate 59 and the control signal CP from the AND gate 59 is provided the gate of the NMOS 23 of the constant current circuit 20NA. Other configuration thereof are the same as in FIG. 1.

The operation thereof will be explained as below.

(1) Operation in the Case where the Driving Voltage Vi is Higher than the Reference Voltage ViH.

The signal S4P, S4N outputted respectively from the output circuit 40P, 40N become level "H" concurrently, and the PMOS 61 of the output buffer 60 becomes off-state and the NMOS 62 thereof becomes on-state. Then the node N6 is connected to the ground voltage GND through the NMOS 62, and the driving voltage Vi from the above N6 falls.

At the above moment, the control signal CS, CP become level "L", then the NMOS 23, 27 becomes off-state and the operation thereof is halted, and the operations of the differential amplifier 30P and output circuit 40P are halted, too. Furthermore, the PMOS 41*b* of the output circuit 40P becomes on-state, then the signal S4P is fixed to level H".

At the same time, since the control signal CN becomes level "H". The NMOS 23 of the constant circuit 20NA becomes on-state, and the normal-mode current responding to the resistor 23 flows in the above constant current circuit 20NA. Subsequently, the normal current flows in the NMOS 62 of the output buffer 60, then the driving voltage Vi falls rapidly.

(2) Operation in the Case where the Driving Voltage Vi is Between the Reference ViH and ViL.

The signal S4P, S4N are level "H", "L", respectively, then the PMOS 61 and the NMOS 62 of the output buffer 60 becomes off-state concurrently. Consequently, the node N6 is separated from the power supply voltage VDD and the ground voltage GND, then the driving voltage Vi of the node N6 is maintained at the same level thereof.

At the above stage, in the case where the changing signal KI is level "L", the control signal CS becomes level "H" and the control signal CP, CN become level "L", then the NMOS 27 of the constant current circuit 20PA, 20NA becomes on-state and the NMOS 23 thereof becomes off-state. Subsequently, a small constant current of the low power consumption mode corresponding to the resistor 28 flows in the constant current 20PA, 20NA. Consequently, the bias voltage VB corresponding to the stand-by state is provided the differential amplifier 30P and the output circuit 40P from the constant circuit 20PA. Additionally, the bias voltage VB corresponding to the stand-by state is provided the differential amplifier 30N and the output circuit 40N from the constant current circuit 20NA.

At the same time, when the changing signal KI becomes level "H" tentatively at a changing timing of the driving voltage driving the segment electrodes or the common electrodes thereof, the control signal CS, CP, and CN become all level "H". Subsequently, the NMOS 23, 27 of the constant current circuit 20PA, 20NA become on-state concurrently, then a large current corresponding to the resistors 24, 27 flows in the constant current circuit 20PA, 20NA. Subsequently, the bias voltage corresponding to the high-speed operation thereof is provided the differential amplifier 30P and the output circuit 40P from the constant current circuit 20PA. Additionally, the bias voltage VB corresponding to the high-speed operation is given to the differential amplifier 30N and the output circuit 40N from the constant current circuit 20NA. Consequently, when the driving voltage becomes out of the reference voltage range of ViL-ViH at the above status, the above out-of-range can be detected immediately, then the adjustment operation thereof is started.

(3) Operation in the Case where the Driving Voltage Vi is Lower than the Reference Voltage ViH.

The signal S4P, S4N become level "L" concurrently, then the PMOS 61 of output buffer 60 become on-state and the NMOS 62 thereof becomes off-state. Subsequently, the node N6 is connected to the ground voltage VDD through the PMOS 61, then the driving voltage Vi outputted from the node N6 thereof rises.

At the above stage, the control signal CS, CN become level "L" and the NMOS 23, 27 of the constant current circuit 20NA becomes off-state, then the operation thereof is halted and the operations of the differential amplifier 30N and the output circuit 40N are halted, too. Furthermore, the NMOS 42*b* of the output circuit 40N becomes on-state and the signal S4N is fixed to level "L".

At the same time, the control signal CP becomes level "H", then the NMOS 23, 27 of the constant current circuit 20PA become on-state and the normal-mode current corresponding to the resistor 24 flows in the above constant current circuit 20PA. Subsequently, the normal mode current flows in the PMOS 61 of the output buffer 60, then the driving voltage Vi rises rapidly.

As explained before, the driving power supply circuit according to the second embodiment of the present invention includes the constant current circuit 20PA, 20NA and logic circuit 50. The constant current circuit 20PA, 20NA can generate the small constant current corresponding to the low-power consumption mode and the large constant current corresponding to the normal mode, based on the control signal CS, CP, and CN. The logic circuit 50 generates the above control signal CS, CP, and CN, based on the signal S4P, S4N controlling the output of the driving voltage Vi. Subsequently, in addition to the effect according to the first embodiment of the invention, the second embodiment of the present invention has an effect that the power consumption in the case where the driving voltage in within the reference voltage range can be further reduced.

Additionally, the above logic circuit 50 is configured to generate the control signal CS, CP, and CN so that a large current corresponding to the normal operation mode can be generated in the case where the changing signal KI is provided thereto when the driving voltage Vi is within the normal reference voltage range. Subsequently, even when the driving voltage driving the segment electrodes or the common electrodes is changed, there is an effect that the driving power supply circuit according to the second embodiment can respond to the changing thereof quickly.

Additionally, the present invention is not limited to the above-mentioned second embodiment and can be applied to various modifications. In addition to the modification example (a), (b) according to the first embodiment of the invention, one of the above modifications is as follows.

(c) The configuration of the logic circuit 50 is one of examples and is not limited to the circuit configuration thereof. For example, a circuit not using the changing signal KI can work. In the above case where the changing signal KI is not used, the normal operation mode is set when the driving voltage Vi is within the reference voltage range, and the adjustment is done in the normal operation mode when the driving voltage Vi is out of the reference voltage range.

What is claimed is:

1. A driving power supply circuit for controlling a driving voltage to have a voltage between a lower reference voltage and a upper reference voltage and for outputting said driving voltage from an output node, comprising;

a p-channel MOS transistor connected between a power supply conductor and said output node and being configured to be ON when a first signal has a first logic level and to be OFF when said first signal has a second logic level;

a n-channel MOS transistor connected between said output node and a ground conductor and being configured to be OFF when a second signal has the first logic level and to be ON when said second signal has the second logic level;

a first comparing circuit configured to compare said driving voltage to said lower reference voltage when said second signal has the first logic level, said first comparing circuit setting said first signal to the second logic level when said driving voltage is higher than said lower reference voltage and setting said first signal to the first logic level when said driving voltage is lower than said lower reference voltage, said first comparing circuit additionally halting the operation thereof and setting said first signal to the second logic level when said second signal has the first logic level; and a second comparing circuit configured to compare said driving voltage to said upper reference voltage when said second signal has the second logic level, said second comparing circuit setting said second signal to the second logic level when said driving voltage is higher than said upper reference voltage and setting said second signal to the first logic level when said driving voltage is lower than said upper reference voltage, said second comparing circuit additionally halting the operation thereof and setting said second signal to the first logic level when said first signal has the first logic level.

2. The driving power supply circuit according to claim 1, wherein the p-channel MOS transistor has a gate and the n-channel MOS transistor has a gate, and further comprising a first output circuit connected between the first comparing circuit and the gate of the p-channel MOS transistor and a second output circuit connected between the second comparing circuit and the gate of the n-channel transistor.

3. The driving power supply according to claim 1, wherein the p-channel MOS transistor has a gate and the n-channel transistor has a gate, and further comprising a first constant current circuit that selectively supplies a first bias voltage to the first comparing circuit, an inverter connected between the gate of the n-channel MOS transistor and a control signal input terminal of the first constant current circuit, and a second constant current circuit that selectively supplies a second bias voltage to the second comparing circuit, the second constant current circuit having a control signal input terminal that is connected to the gate of the p-channel MOS transistor.

4. The driving power supply circuit according to claim 2, further comprising an inverter connected between the gate of the p-channel MOS transistor and the second output circuit, and another inverter connected between the gate of the n-channel MOS transistor and the first output circuit.

5. The driving power supply circuit according to claim 4, further comprising a first constant current circuit that selectively supplies a first bias voltage to the first comparing circuit, an inverter connected between the gate of the n-channel MOS transistor and a control signal input terminal of the first constant current circuit, and a second constant current circuit that selectively supplies a second bias voltage to the second comparing circuit, the second constant current circuit having a control signal input terminal that is connected to the gate of the p-channel MOS transistor.

6. The driving power supply circuit according to claim 5, further comprising a first starting circuit having an output terminal that is connected to the first constant current source, the first comparing circuit, and the first output circuit, and a second starting circuit having an output terminal that is connected to the second constant current source, the second comparing circuit, and the second output circuit.

7. The driving power supply circuit according to claim 6, wherein the first starting circuit comprises a first resistor connected in series with at least one first diode-connected transistor and the second starting circuit comprises a second resistor connected in series with at least one second diode-connected transistor.

* * * * *